US005835016A

United States Patent [19]

Ho et al.

[11] Patent Number: 5,835,016

[45] Date of Patent: Nov. 10, 1998

[54] MULTI-THREAD RE-ENTRANT MARKER WITH TRANSVERSE ANISOTROPY FLUX CONCENTRATORS

[75] Inventors: Wing Ho, Boynton Beach, Fla.; Jiro Yamasaki, Fukuoka, Japan

[73] Assignee: Sensormatic Electronics Corporation, Boca Raton, Fla.

[21] Appl. No.: 990,255

[22] Filed: Dec. 15, 1997

[51] Int. Cl.[6] ..... G08B 13/14

[52] U.S. Cl. ..... 340/568; 340/551; 340/572; 148/108

[58] Field of Search ..... 340/568, 551, 340/572; 148/108, 304, DIG. 3; 428/661, 928

[56] References Cited

U.S. PATENT DOCUMENTS

| | | | |
|---|---|---|---|
| 4,660,025 | 4/1987 | Humphrey | 340/572 |
| 4,710,754 | 12/1987 | Montean | 340/572 |
| 4,980,670 | 12/1990 | Humphrey et al. | 340/572 |
| 5,519,379 | 5/1996 | Ho et al. | 340/551 |
| 5,650,236 | 7/1997 | Hirano et al. | 340/551 |

*Primary Examiner*—Jeffery A. Hofsass
*Assistant Examiner*—Anh La
*Attorney, Agent, or Firm*—Robin, Blecker & Daley

[57] ABSTRACT

A marker for a harmonic electronic article surveillance system includes three wires of magnetic material arranged in parallel. The material has a magnetic hysteresis loop with a large Barkhausen discontinuity such that, upon exposure of the marker to an external magnetic field whose field strength in the direction opposing the instantaneous magnetic polarization of the marker exceeds a predetermined threshold value, there results a regenerative reversal of the magnetic polarization in the material. The three wires are coupled at opposite ends thereof by flux concentrating elements formed of a highly permeable material so that all three wires exhibit the regenerative reversal simultaneously on exposure to the above-described magnetic field. The flux concentrators have magnetic anisotropies oriented transversely relative to the length of the wires to aid in coupling the wires for simultaneous switching.

16 Claims, 5 Drawing Sheets

FIG. 6
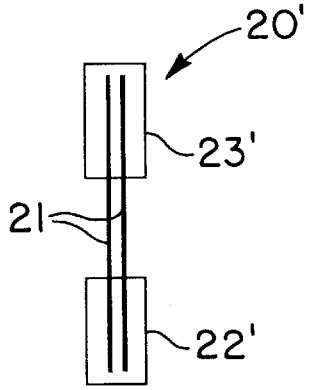
FIG. 7
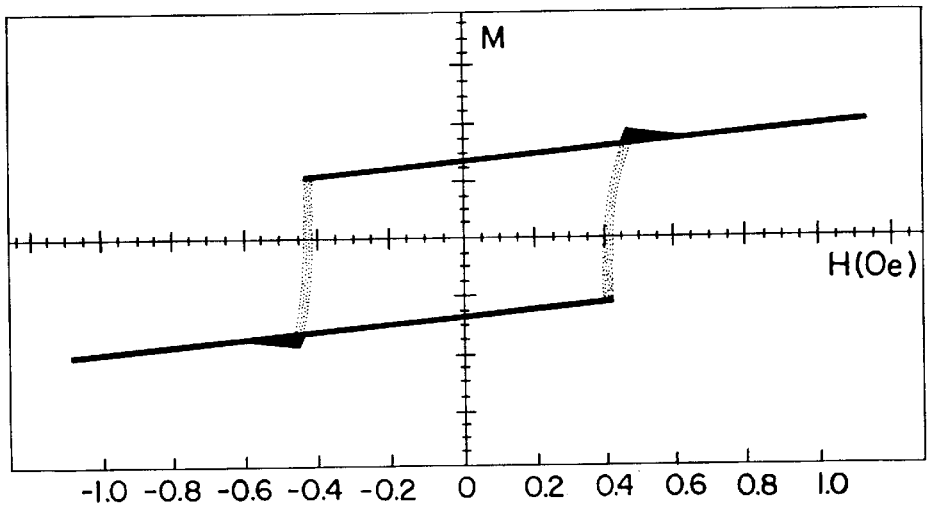
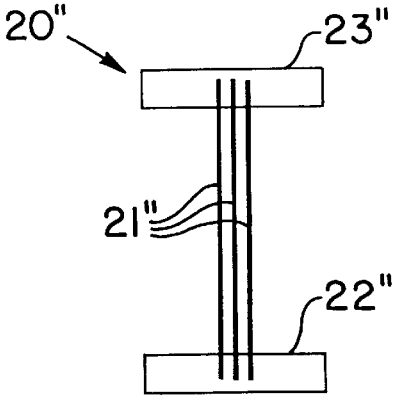
FIG. 8
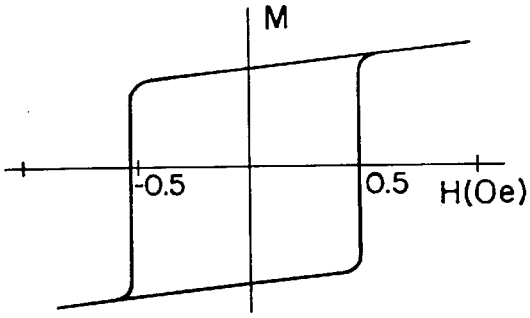
FIG. 9

MULTI-THREAD RE-ENTRANT MARKER WITH TRANSVERSE ANISOTROPY FLUX CONCENTRATORS

FIELD OF THE INVENTION

This invention relates to article surveillance and more particularly to article surveillance systems generally referred to as of the harmonic type.

BACKGROUND OF THE INVENTION

It is well known to provide electronic article surveillance (EAS) systems to prevent or deter theft of merchandise from retail establishments. In a typical system, markers designed to interact with a magnetic field placed at the store exit are secured to articles of merchandise. If a marker is brought into the field or "surveillance zone," the presence of the marker is detected and an alarm is generated.

One type of magnetic EAS system is referred to as a harmonic system because it is based on the principle that a magnetic material passing through an electromagnetic field having a selected frequency disturbs the field and produces harmonic perturbations of the selected frequency. The detection system is tuned to recognize certain harmonic frequencies and, if present, causes an alarm.

A basic problem in the design of markers for harmonic EAS systems is the need to have the marker generate a harmonic signal that is both of sufficient amplitude to be readily detectable and also is sufficiently unique so that the detection equipment can be tuned to detect only the signal generated by the marker, while disregarding harmonic disturbances caused by the presence of items such as coins, keys, and so forth. A known approach to this problem is to develop markers that produce high order harmonics with sufficient amplitude to be readily detectable. A particularly useful technique along these lines is disclosed in U.S. Pat. No. 4,660,025, issued to Humphrey, the disclosure of which is incorporated herein by reference. The Humphrey patent discloses a harmonic EAS marker employing as its active element a wire of magnetic material which has a magnetic hysteresis loop with a large discontinuity, known as a "Barkhausen discontinuity." Upon exposure to an alternating magnetic field of sufficient amplitude, the active element undergoes substantially instantaneous regenerative reversals in magnetic polarity, producing very sharp signal spikes that are rich in detectable high harmonics of the frequency of the alternating field. Because of the shape of its hysteresis loop, the active element is sometimes referred to as "re-entrant."

Markers employing the type of active element just described have been successfully placed in practice, and are in widespread use with harmonic EAS systems distributed by the assignee of the present application under the trademark "AISLEKEEPER."

In U.S. Pat. No. 5,519,379, which has the same inventors and the same assignee as the present application, a harmonic marker was proposed in which two or more re-entrant wires are arranged in parallel. The parallel wires are magnetically coupled with charge-spreading elements (which also may be referred to as flux-concentrating elements) provided at each end of the parallel wires, so that all of the wires are caused to switch their magnetic polarities substantially simultaneously. A marker employing the parallel wires, coupled as taught in the '379 patent, can be substantially shorter in length than markers which include a single, longer wire, while producing harmonic signals of substantially the same amplitude as the longer single-wire marker. The disclosure of the '379 patent is incorporated herein by reference.

According to the teachings of the '379 patent, the flux concentrating elements provided to couple the ends of the parallel wires are arranged to have a magnetic anisotropy oriented parallel to the wires. It is also noted in the '379 patent that, at each end of the wire array, the ends of all of the wires should be coupled through a single domain in the flux concentrating element to obtain the desired simultaneous switching of magnetic polarity of all of the wires. However, in practice, it can be difficult to assure that all of the wire ends are in contact with the same magnetic domain of the flux concentrating element.

OBJECTS AND SUMMARY OF THE INVENTION

It is an object of the invention to provide a relatively short harmonic EAS marker incorporating a plurality of short, thin, re-entrant elements.

It is a more particular object of the invention to provide such a marker that can be manufactured with consistently satisfactory results.

According to the invention, there is provided a marker for use in an article surveillance system in which an alternating magnetic field is established in a surveillance region and an alarm is activated when a predetermined perturbation to the field is detected, with the marker including a plurality of elongate bodies of magnetic material arranged substantially in parallel with each other; a first flux concentrator coupling the elongate bodies at respective first ends of the bodies; a second flux concentrator coupling the elongate bodies at respective second ends of the bodies; and means for securing the bodies and the flux concentrators to an article to be maintained under surveillance; wherein the marker has a magnetic hysteresis loop with a large Barkhausen discontinuity such that exposure of the marker to an external magnetic field, whose field strength in the direction opposing the magnetic polarization of the elongate bodies exceeds a predetermined threshold value, results in regenerative reversal of the magnetic polarization, and the first and second flux concentrators have magnetic anisotropies that are oriented at a substantial angle relative to a longitudinal axis of the elongate bodies.

Preferably, the plurality of elongate bodies consists of three wires arranged substantially in parallel, and the direction of magnetic anisotropy of the flux concentrators is substantially perpendicular to the length of the wires.

In a marker provided in accordance with the invention, magnetic domains in the flux concentrators cross the length direction of the active element wires, thereby assuring that the wires are coupled to obtain essentially simultaneous switching of magnetic polarity upon exposure to the alternating interrogation field.

BRIEF DESCRIPTION OF THE DRAWINGS

FIG. 6 is a schematic plan view of an alternative embodiment of the invention.

FIG. 7 shows a hysteresis loop characteristic of the marker of FIG. 6.

FIG. 8 is a schematic plan view of another alternative embodiment of the invention.

FIG. 9 shows a hysteresis loop characteristic of the marker of FIG. 8.

The same reference numerals are used throughout the drawings to designate the same or similar parts.

DESCRIPTION OF THE PREFERRED EMBODIMENTS

Figure 1:
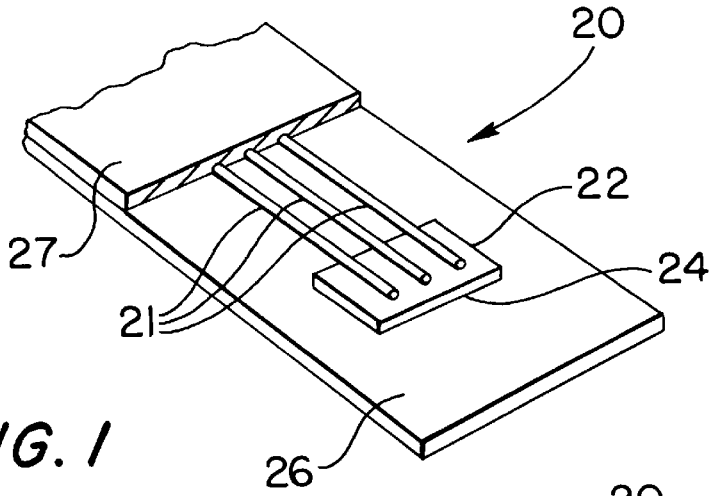
FIG. 1 is a perspective view with portions broken away of a harmonic EAS marker according to a first embodiment of the invention.
Figure 2:
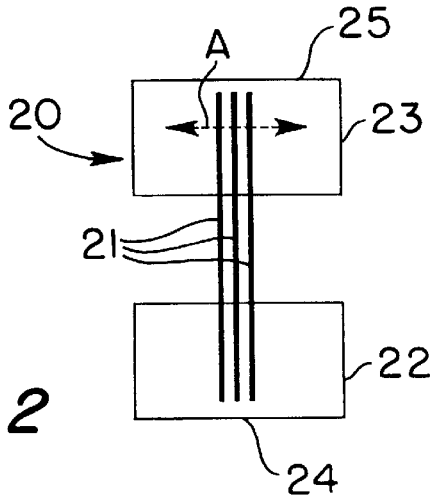
FIG. 2 is a schematic plan view of the marker of FIG. 1.

Referring to FIGS. 1 and 2, a marker in accordance with the present invention is generally indicated by reference numeral 20. The marker 20 includes three re-entrant wires 21 arranged in parallel and a flux concentrating member 22 connecting the ends of the wires 21 so as to magnetically couple the wires 21 and to reduce the demagnetizing effect at the ends of the re-entrant wires. As seen in FIG. 2, the opposite ends of the wires 21 are also magnetically coupled by a second flux concentrator 23. As shown in FIGS. 1 and 2, the respective ends of wires 21 at one end of the marker 20 approach an outer edge 24 of flux concentrator 22. Also, the ends of the wires 21 at the other end of the marker 20 approach an outer edge 25 of flux concentrator 23.

The functional elements of the marker 20, namely wires 21 and flux concentrators 22 and 23, are sandwiched between a substrate 26 and an overlayer 27 (FIG. 1), which are like those employed in conventional harmonic markers. As is conventional, an adhesive may be provided on the lower surface of the substrate 26 to attach the marker 20 to an article to be maintained under surveillance.

The marker shown in FIGS. 1 and 2 departs from those described in the '379 patent in that, in the marker of the present invention, the flux concentrators 22 and 23 both have magnetic anisotropies (easy axes) oriented in a direction indicated by double-headed arrow A in FIG. 2. That is, the magnetic anisotropies of the flux concentrators 22 and 23 are transverse and substantially perpendicular to the length of the wires 21. In the flux concentrators 22 and 23, the magnetic domains extend across the width (i.e., the direction perpendicular to the length of the wires 21) of the flux concentrators so that the wires 21 straddle multiple domains and the magnetization of the wires is readily coupled to the change in polarity of the domains in the flux concentrators. Consequently, the desired simultaneous switching response of the three wires is relatively insensitive to the precise placement of the wires with respect to the flux concentrators.

The wires 21 and the flux concentrators 22 and 23, shown herein, may be like the corresponding elements disclosed in the '379 patent. In a particular example of the marker of the present invention, the three wires 21 are discrete 30 mm lengths cut from a continuous amorphous wire that is die-drawn to a diameter of 0.090 mm and then tension-annealed to relieve some of the stress which resulted from die-drawing. A preferred composition of the wire is $Fe_{77.5}Si_{7.5}B_{15}$ (atomic percent).

The flux concentrators are planar, rectangular sections of an amorphous ribbon that was field annealed to control the direction of magnetic anisotropy, with the flux concentrators having dimensions 25 mm by 12.5 mm and the longer side of the flux concentrators arranged transverse to the length of the wires. A preferred composition of the flux concentrators is $(Co_{0.94}Fe_{0.06})_{79}Si_{2.1}B_{18.9}$ (atomic percent).

Figure 3:
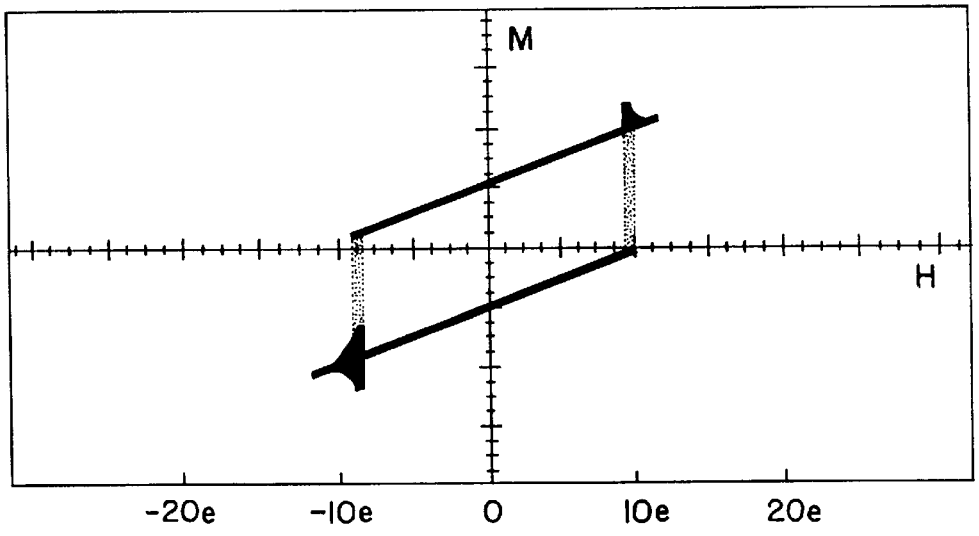
FIG. 3 shows a hysteresis loop characteristic of the marker of FIG. 1.

The hysteresis loop of the marker formed with the above-specified wires and flux concentrators is shown in FIG. 3. It will be observed that the switching threshold level is at about 1 Oe.

Figure 4:
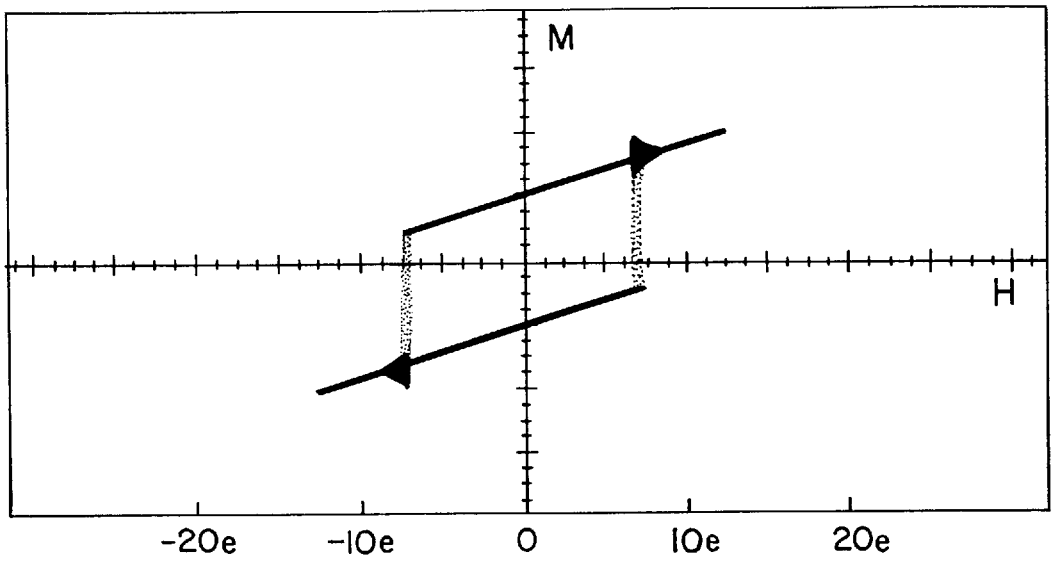
FIG. 4 shows the hysteresis loop characteristic of a modification of the marker of FIG. 1.

If the width of the flux concentrators is reduced from 25 mm to 20 mm, the switching threshold of the resulting marker is reduced, as illustrated in FIG. 4. It will be seen that the marker formed with the narrower flux concentrators has a switching threshold at about 0.7 Oe.

Figure 5:
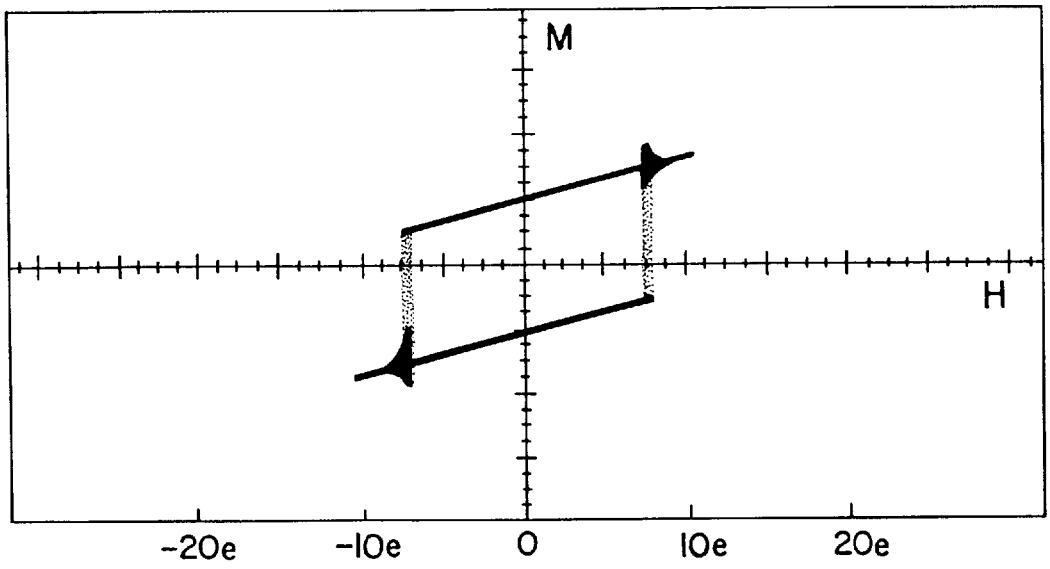
FIG. 5 shows the hysteresis loop characteristic of another modification of the marker of FIG. 1.

A further reduction in the width of the flux concentrators from 20 mm to 15 mm has essentially no further effect of the hysteresis loop characteristic, which is shown in FIG. 5.

FIG. 6 shows a schematic plan view of a modified embodiment of the marker, in which only two wires 21 are employed. The wire segments used in the embodiment of the FIG. 6 are the same as those of the embodiment of FIGS. 1 and 2, but the flux concentrators 22' and 23' of the embodiment of FIG. 6 have dimensions 6 mm by 12.5 mm, with the longer dimension of flux concentrators 22' and 23' arranged parallel to the length of the wires 21. As in the embodiment of FIGS. 1 and 2, the flux concentrators 22' and 23' have magnetic anisotropies oriented in a transverse direction relative to the length of the wires 21.

The hysteresis loop characteristic of the marker is shown in FIG. 7, and exhibits a switching threshold at about 0.4 Oe.

Another embodiment of the invention is shown in schematic plan view in FIG. 8. The marker 20" of FIG. 8 employs three wire segments 21' each having a length of 40 mm and a diameter of 0.030 mm. The dimensions of the flux concentrators 22" and 23" of the embodiment of FIG. 8 are 25 mm by 2 mm, with the long dimension of the flux concentrators perpendicular to the length of the wires. As in the embodiments described in connection with FIGS. 1 and 6, the flux concentrators 22" and 23" have magnetic anisotropies oriented perpendicular to the length of the wires.

Figure 10:
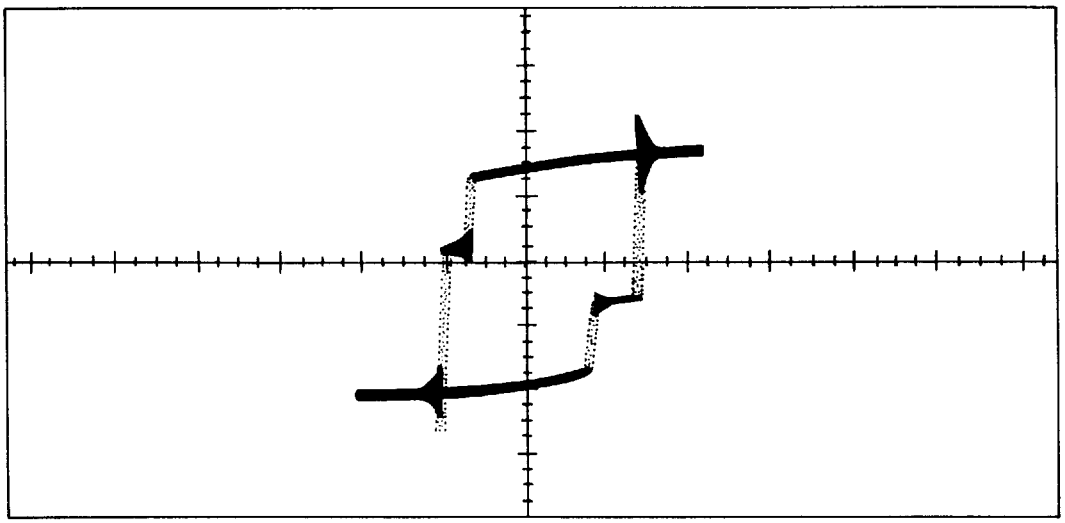
FIG. 10 shows a hysteresis loop characteristic obtained when the embodiment of FIG. 8 is modified so that the desirable simultaneous switching of the active elements is no longer obtained.

The marker shown in FIG. 8 has a switching level at about 0.5 Oe, as shown from its hysteresis loop characteristic (FIG. 9). However, if the longer dimension of the flux concentrators of the marker of FIG. 8 is reduced from 25 mm to 15 mm, the desired simultaneous switching of the three wires is no longer obtained, as shown from the resulting hysteresis loop characteristic illustrated in FIG. 10.

Figure 11:
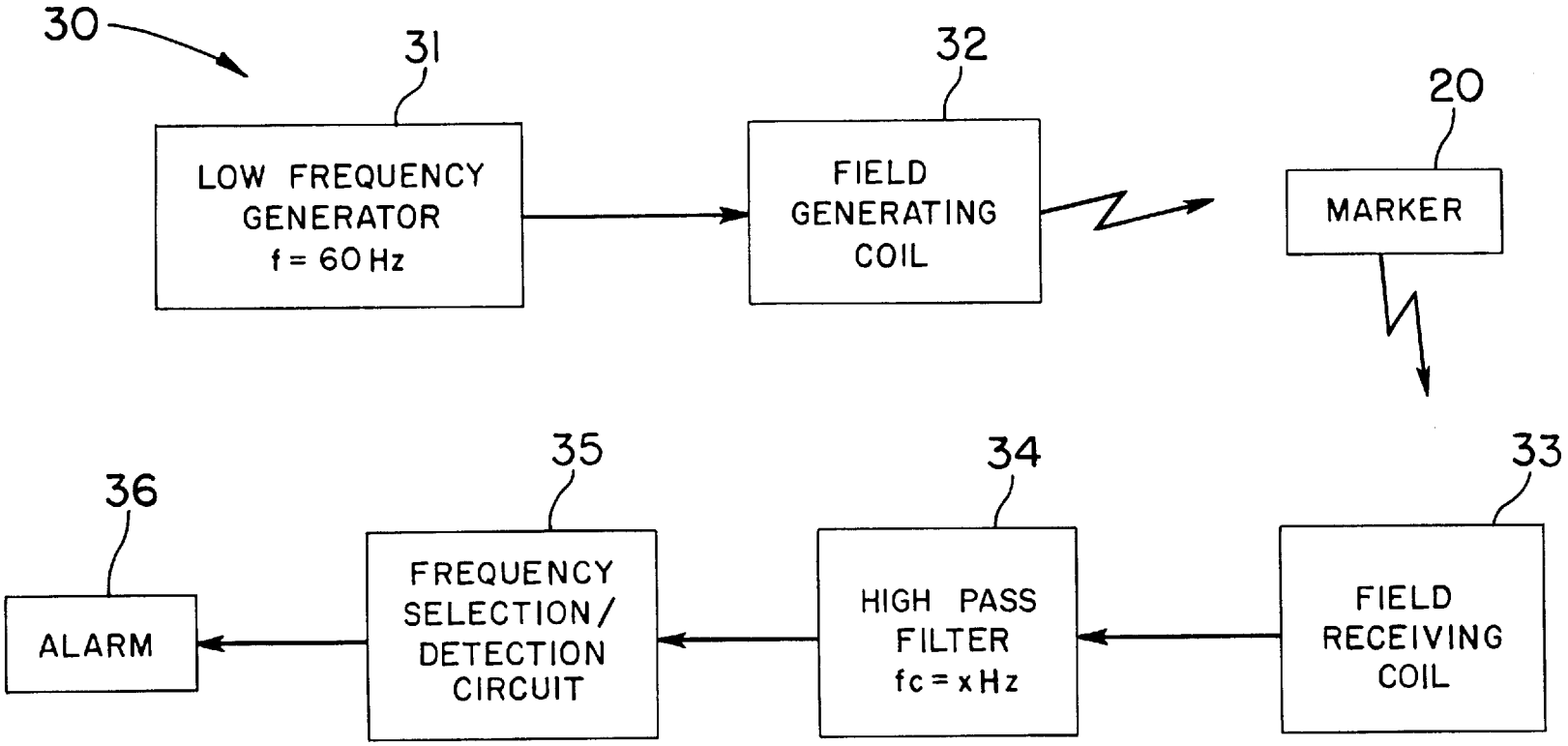
FIG. 11 is a block diagram of a typical system for generating a surveillance field and detecting the markers of the present invention.

A harmonic EAS system with which the markers of the invention may be used is illustrated in block diagram form in FIG. 11. This system, generally indicated by reference numeral 30, includes a low-frequency generator 31 which generates a signal with a frequency around 60 Hz to drive a field generating coil 32. When a marker 20 is present in the field generated by the coil 32, perturbations caused by the marker 20 are received at a field receiving coil 33. A signal output from the field receiving coil 33 passes through a high pass filter 34, which has a suitable cut-off frequency. The signal which passes through the filter 34 is supplied to a frequency selection/detection circuit 35, which can be set to detect a signal having a predetermined pattern of frequency, amplitude and/or pulse duration. Upon detection of the predetermined signal pattern, the circuit 35 furnishes an output signal to activate an alarm 36. Except for the marker 20, all of the elements shown in FIG. 11 may be like those presently used in the aforementioned "AISLEKEEPER" harmonic EAS system.

If it is desired that the markers disclosed herein be deactivatable, then a control element (not shown) of a conventional type, such as a semi-hard magnet formed of Arnokrome 3 or Crovac, may be included in the markers. Deactivation of the markers can then be performed by magnetizing the control element to provide a bias field which changes the response of the wire segments to the surveillance field. It is also contemplated to deactivate the markers by relieving stress in the wire segments or crystallizing the wire segments in the case where the wire segments are formed of an amorphous material.

In the embodiments of the invention described above, it has been indicated that the orientation of the magnetic anisotropies of the flux concentrators should be substantially perpendicular to the length of the wires which comprise the active elements of the marker to obtain substantially simultaneous reversal of the magnetic polarities of the active elements in response to the alternating interrogation field provided by detection equipment. However, it is believed that similar effects can be achieved when the magnetic anisotropies of the flux concentrators are at angles between perpendicular and parallel to the length of the wires, so long as the orientation of the anisotropies of the flux concentrators is at a substantial angle relative to the length of the wires.

Also, although only two flux concentrators are shown in the embodiments described above, it is contemplated to use four flux concentrators in the marker, with a pair of flux concentrators provided at each end of the wires and the wires sandwiched at each end between the respective pair of flux concentrators.

Furthermore, it is contemplated to use more than three wire segments in the marker.

Having described the present invention with reference to the presently preferred embodiments thereof, it should be understood that various changes in addition to those described above can be made without departing from the true spirit of the invention as defined in the appended claims.

What is claimed is:

1. A marker for use in an article surveillance system in which an alternating magnetic field is established in a surveillance region and an alarm is activated when a predetermined perturbation to said field is detected, said marker comprising:

a plurality of elongate bodies of magnetic material arranged substantially in parallel with each other;

a first flux concentrator coupling said elongate bodies at respective first ends of said bodies;

a second flux concentrator coupling said elongate bodies at respective second ends of said bodies; and means for securing said bodies and said flux concentrators to an article to be maintained under surveillance;

said marker having a magnetic hysteresis loop with a large Barkhausen discontinuity such that exposure of said marker to an external magnetic field, whose field strength in the direction opposing the magnetic polarization of said elongate bodies exceeds a predetermined threshold value, results in regenerative reversal of said magnetic polarization;

wherein said first and second flux concentrators have respective magnetic anisotropies, said magnetic anisotropies of said flux concentrators being oriented at a substantial angle relative to a longitudinal axis of said elongate bodies.

2. A marker according to claim 1, wherein said plurality of bodies includes three such bodies.

3. A marker according to claim 2, wherein each of said three bodies is a length of amorphous metal wire.

4. A marker according to claim 3, wherein said three bodies are substantially identical in size, shape and composition.

5. A marker according to claim 1, wherein said magnetic anisotropies of said flux concentrators are oriented substantially perpendicular to said longitudinal axis of said elongate bodies.

6. A marker according to claim 1, wherein said predetermined threshold value does not exceed about 1 Oe.

7. An article surveillance system comprising:

(a) generating means for generating an alternating magnetic field in a surveillance region;

(b) a marker secured to an article appointed for passage through said surveillance region, said marker including a plurality of elongate bodies of magnetic material arranged substantially in parallel with each other, a first flux concentrator coupling said elongate bodies at respective first ends of said bodies, and a second flux concentrator coupling said elongate bodies at respective second ends of said bodies, said first and second flux concentrators having respective magnetic anisotropies, said magnetic anisotropies of said flux concentrators being oriented at a substantial angle relative to a longitudinal axis of said elongate bodies; said marker having a magnetic hysteresis loop with a large Barkhausen discontinuity such that exposure of said marker to an external magnetic field, whose field strength in the direction opposing the magnetic polarization of said elongate bodies exceeds a predetermined threshold value, results in regenerative reversal of said magnetic polarization; and (c) detecting means for detecting a perturbation to said alternating magnetic field in said surveillance region resulting from the presence of said marker in said surveillance region.

8. An article surveillance system according to claim 7, wherein said plurality of bodies includes three such bodies.

9. An article surveillance system according to claim 8, wherein each of said three bodies is a length of amorphous metal wire.

10. An article surveillance system according to claim 9, wherein said three bodies are substantially identical in shape, size and composition.

11. An article surveillance system according to claim 7, wherein said magnetic anisotropies of said flux concentrators are oriented substantially perpendicular to said longitudinal axis of said elongate bodies.

12. An article surveillance system according to claim 7, wherein said predetermined threshold value does not exceed about 1 Oe.

13. A method of making a marker for use in an article surveillance system in which an alternating magnetic field is established in a surveillance region and an alarm is activated when a predetermined perturbation to said field is detected, the method comprising the steps of:

providing a plurality of elongate bodies of magnetic material;

providing two flux concentrators, said flux concentrators each having a respective magnetic anisotropy;

mounting said plurality of elongate bodies on said flux concentrators with said elongate bodies arranged substantially parallel to each other and with respective first ends of said elongate bodies on one of said two flux concentrators and respective second ends of said elongate bodies on the other of said two flux concentrators, and with the magnetic anisotropies of said flux concentrators being oriented at a substantial angle relative to a longitudinal axis of said elongate bodies.

14. A method according to claim 13, wherein the magnetic anisotropies of said flux concentrators are oriented substantially perpendicular to said longitudinal axis of said elongate bodies.

15. A method according to claim 13, wherein said step of providing said flux concentrators includes annealing an amorphous metal ribbon in the presence of a saturating DC magnetic field to control a direction of magnetic anisotropy of said ribbon and cutting said annealed ribbon to form said flux concentrators.

16. A method according to claim 13, wherein said step of providing said plurality of elongate bodies includes die-drawing an amorphous metal wire, said die-drawn wire having residual stress therein, and then annealing said die-drawn wire to relieve some of said residual stress.

* * * * *